US011834748B2

(12) United States Patent
Zheng et al.

(10) Patent No.: US 11,834,748 B2
(45) Date of Patent: Dec. 5, 2023

(54) METHOD FOR PREPARING A PROTECTIVE COATING ON A SURFACE OF KEY COMPONENTS AND PARTS OF IC DEVICES BASED ON PLASMA SPRAYING TECHNOLOGY AND COLD SPRAYING TECHNOLOGY

(71) Applicant: SHENYANG FORTUNE PRECISION EQUIPMENT CO., LTD., Liaoning (CN)

(72) Inventors: Guangwen Zheng, Liaoning (CN); Tianying Xiong, Liaoning (CN); Yanfang Shen, Liaoning (CN); Xinyu Cui, Liaoning (CN); Jiqiang Wang, Liaoning (CN); Junrong Tang, Liaoning (CN); Ning Li, Liaoning (CN); Jianzhong Qi, Liaoning (CN); Yongshan Tao, Liaoning (CN)

(73) Assignee: SHENYANG FORTUNE PRECISION EQUIPMENT CO., LTD, Liaoning (CN)

( * ) Notice: Subject to any disclaimer, the term of this patent is extended or adjusted under 35 U.S.C. 154(b) by 6 days.

(21) Appl. No.: 17/631,810

(22) PCT Filed: Jan. 13, 2020

(86) PCT No.: PCT/CN2020/071775
§ 371 (c)(1),
(2) Date: Jan. 31, 2022

(87) PCT Pub. No.: WO2021/022791
PCT Pub. Date: Feb. 11, 2021

(65) Prior Publication Data

US 2022/0275518 A1 Sep. 1, 2022

(30) Foreign Application Priority Data

Aug. 5, 2019 (CN) ..... 201910716325.2

(51) Int. Cl.
*C23C 28/00* (2006.01)
*C23C 4/134* (2016.01)
(Continued)

(52) U.S. Cl.
CPC ..... *C23C 28/345* (2013.01); *C23C 4/06* (2013.01); *C23C 4/134* (2016.01); *C23C 24/04* (2013.01)

(58) Field of Classification Search
CPC ..... C23C 28/345; C23C 4/134; C23C 4/06; C23C 24/04
See application file for complete search history.

(56) References Cited

U.S. PATENT DOCUMENTS

2013/0284373 A1* 10/2013 Sun ..... H01J 37/32467 174/255

FOREIGN PATENT DOCUMENTS

CN 109957748 * 7/2019

* cited by examiner

*Primary Examiner* — Nathan T Leong

(57) ABSTRACT

Through the plasma spraying technology and the cold spraying high-speed deposition technology, an evenly distributed protective coating is formed on the surface of a plasma etching chamber. The protective coating, having a double-layer composite structure, includes a metal+$Y_2O_3$ coating as a metal+$Y_2O_3$ transition layer deposited by plasma spraying as a lower layer of the double-layer composite structure, and a high-purity $Y_2O_3$ ceramic coating coated on the metal+$Y_2O_3$ transition layer as an upper layer of the double-layer composite structure, the metal+$Y_2O_3$ transition layer is configured to reduce the difference in expansion coefficient between the $Y_2O_3$ ceramic coating and the metal substrate, and enhance the bonding force between the $Y_2O_3$ ceramic coating and the metal substrate; the high-purity $Y_2O_3$ ceramic coating is formed by depositing $Y_2O_3$ ceramic
(Continued)

powders on the metal+$Y_2O_3$ transition layer at high speed through cold spraying high-speed deposition.

16 Claims, 1 Drawing Sheet

(51) Int. Cl.
*C23C 4/06* (2016.01)
*C23C 24/04* (2006.01)

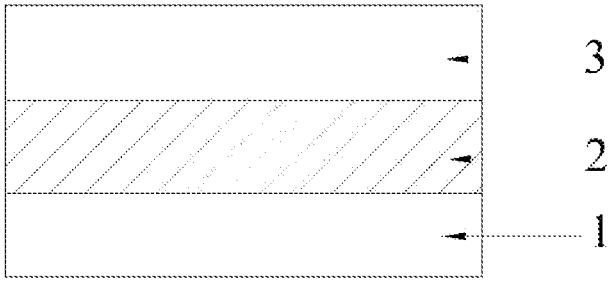
3
2
1

METHOD FOR PREPARING A PROTECTIVE COATING ON A SURFACE OF KEY COMPONENTS AND PARTS OF IC DEVICES BASED ON PLASMA SPRAYING TECHNOLOGY AND COLD SPRAYING TECHNOLOGY

CROSS REFERENCE OF RELATED APPLICATION

This is a U.S. National Stage under 35 U.S.C 371 of the International Application PCT/CN2020/071775, filed Jan. 13, 2020, which claims priority under 35 U.S.C. 119(a-d) to CN 201910716325.2, filed Aug. 5, 2019.

BACKGROUND OF THE PRESENT INVENTION

Field of Invention

The present invention relates to the preparation technology of ceramic coating, and more particularly to a method for preparing a protective coating on a surface of key components and parts of an IC (integrated circuit) device based on plasma spraying technology and cold spraying technology, which belongs to the field of semiconductor integrated circuit chip (wafer) plasma etching.

Description of Related Arts

In the etching manufacturing device (such as a device for manufacturing semiconductor materials and liquid crystal displays) of IC equipment, it is necessary to resist the etching effect of high-energy plasma, so that when the substrate material is unable to meet the protection requirements, a protective coating is prepared on the surface of the substrate material to extend the service life thereof. High-purity alumina and high-purity yttria have been widely used as anti-plasma erosion materials due to their excellent resistance to plasma erosion. Research on the relative performance of the coating under different plasma energies shows that the high-purity yttria coating has better plasma erosion resistance than the high-purity alumina coating. The performance of yttria coating is slightly lower than that of yttria sintered block, but with the increase of plasma energy, the difference in performance between the two is gradually reduced. Therefore, with the continuous increase of plasma energy under actual working conditions, the yttria coating has also been more widely used.

The preparation method of high-purity yttria coating by thermal spraying technology includes steps of heating yttria ceramic powders to above 2000° C. to be in a molten state, and then obtaining a ceramic coating by highly depositing on a substrate material. The preparation conditions are harsh and expensive. Moreover, the outermost layer of the coating has transverse cracks and is not dense enough, so the coating needs to be improved in quality.

Plasma spraying is a relatively mature technology in thermal spraying. In plasma spraying process, after being injected into the high-temperature plasma jet, metal or non-metal powders are accelerated and sprayed at high speed onto the surface of the pre-treated workpiece in a molten or semi-melted state under the action of a high-speed jet, and then a coating with certain properties and functions is formed by layer-by-layer deposition. The ceramic coating prepared by plasma spraying has both technical and commercial advantages in solving the problem of plasma erosion resistance of IC equipment. Firstly, there is no limit to the size of processing devices during the process of preparing the coating. Secondly, the coating has relatively high plasma erosion resistance. Thirdly, the coating with a thickness up to several hundred microns is able to be prepared through plasma spraying. However, the coating prepared by plasma spraying also has certain defects, such as high porosity, which will affect the service life of the coating if used directly as a protective coating. Therefore, it is considered to deposit a layer of high-purity $Y_2O_3$ protective coating with higher density on the surface of the plasma sprayed ceramic coating. The high-purity $Y_2O_3$ protective coating deposited at high speed by cold spraying is combined with the high-purity plasma sprayed $Y_2O_3$ coating and the metal+$Y_2O_3$ coating by plasma spraying, so as to obtain a new protective coating against plasma erosion.

The basic principle of cold spraying technology is that the supersonic air flow carries spray powders to hit the surface of the substrate material at a very high speed (usually in a range of 400-1200 m/s), so that strong plastic deformation occurs on the surface of the substrate material and the spray powders are deposited on the surface of the substrate to form a coating. Due to the high deposition rate, the microstructure of the cold spraying coating is different from that of the plasma spraying coating, and the density of the cold spraying coating is higher than that of the plasma spraying coating. When the ceramic coating is prepared by cold spraying technology, the properties of the ceramic powders used are critical. Ordinary nano-powders are not suitable for preparing the cold spraying coating, because the high-pressure high-speed air flow of cold spraying will form bow shock waves on the surface of the substrate, which hinders the deposition of nano-powders. Moreover, when the particle size of powders to be sprayed is too large, the substrate will be eroded, so that it is difficult to form a coating.

At present, research on the protective coating of the plasma etching chamber of IC equipment focuses on the ceramics and composite coating based on yttria. Seok et al. (Seok H W, Kim Y C, Chol E Y, et al. Multi-component thermal spray coating material and production method and coating method thereof. U.S. Ser. No. 13/915,976[P]. 2013 Jun. 12.) prepare several corrosion resistant coatings by atmospheric plasma spraying, such as $Al_2O_3$ coating, $Y_2O_3$ coating, multiple $Y_2O_3$—$ZrO_2$ composite coatings with different $Y_2O_3$ contents, and $Y_2O_3$—$ZrO_2$—$Al_2O_3$ composite coating, and test the corrosion rate of these coatings. It is concluded that the corrosion rate of the $Y_2O_3$—$ZrO_2$ composite coatings is basically smaller than that of the $Y_2O_3$ coating, and when a mass content ratio of $Y_2O_3$ to $ZrO_2$ in the $Y_2O_3$—$ZrO_2$ composite coating is 70:30, the corrosion rate of the $Y_2O_3$—$ZrO_2$ composite coating is the smallest and about 5 nm/min, that is, the plasma corrosion resistance is the best. However, there is a big difference between the thermal expansion coefficient of the ceramic coating and that of the metal substrate, which leads to the decrease of matching and bonding strength of the two, and affects the mechanical properties and corrosion resistance of the coating. Therefore, the metal+ceramics coating is used to be the bottom and transition layer to reduce the difference in the thermal expansion coefficient between the ceramic coating and the metal substrate, so as to further improve the overall mechanical properties and corrosion resistance of the coating.

SUMMARY OF THE PRESENT INVENTION

Aiming at deficiencies of the prior art, an object of the present invention is to provide a method for preparing a protective coating on a surface of key components and parts of an IC (integrated circuit) device based on plasma spraying technology and cold spraying technology, which solves the problem that the current protective coating of plasma etching chamber of IC devices is prone to failure during high-power etching, and provides a new effective way to prepare the protective coating on the surface of the plasma etching chamber of IC devices, so as to obtain practical applications as soon as possible.

To achieve the above object, the present invention adopts technical solutions as follows:

A method for preparing a protective coating on a surface of key components and parts of an IC (integrated circuit) device based on plasma spraying technology and cold spraying technology adopts the plasma spraying technology and cold spraying high-speed deposition technology to form an evenly distributed protective coating on a surface of a plasma etching chamber of the IC device, wherein the protective coating, having a double-layer composite structure, comprises a metal+$Y_2O_3$ transition layer deposited by plasma spraying as a lower layer of the double-layer composite structure, and a high-purity $Y_2O_3$ ceramic coating coated on the metal+$Y_2O_3$ transition layer as an upper layer of the double-layer composite structure, the high-purity $Y_2O_3$ ceramic coating is formed by depositing $Y_2O_3$ ceramic powders on the metal+$Y_2O_3$ transition layer at high speed through cold spraying high-speed deposition. The method comprises steps of drying metal powders and $Y_2O_3$ powders, respectively, and then obtaining a metal+$Y_2O_3$ layer by depositing the metal and $Y_2O_3$ powders on a substrate at high speed through supersonic plasma spraying technology, and then depositing high-purity $Y_2O_3$ powders on the metal+$Y_2O_3$ layer through cold spraying high-throughout deposition technology, so as to obtain the protective coating through controlling process parameters.

Accordingly, a method for preparing a protective coating on a surface of key components and parts of an IC device based on plasma spraying technology and cold spraying technology comprises steps of:

(1) drying metal powders to be sprayed and $Y_2O_3$ powders to be sprayed, respectively, wherein a purity of the metal powders and the $Y_2O_3$ powders is above 99.9 wt. %;

(2) preparing a metal+$Y_2O_3$ transition layer on a substrate through plasma spraying technology, which comprises:

placing the dried metal and $Y_2O_3$ powders into a powder feeder of a plasma spraying device, obtaining mixed powders after evenly mixing the dried metal and $Y_2O_3$ powders, melting and depositing the mixed powders on an inner surface of a plasma etching chamber through the plasma spraying technology, so as to obtain the metal+$Y_2O_3$ transition layer; and (3) depositing a high-purity $Y_2O_3$ coating through cold spraying high-speed deposition technology, which is specifically embodied as depositing high-purity $Y_2O_3$ powders through the cold spraying high-speed deposition technology on the metal+$Y_2O_3$ transition layer obtained by the step (2), so as to obtain the high-purity $Y_2O_3$ coating, whereby, a (metal+$Y_2O_3$)/$Y_2O_3$ composite protective coating, namely, the protective coating is obtained.

Preferably, in the method for preparing the protective coating on the surface of the key components and parts of the IC device based on the plasma spraying technology and the cold spraying technology, the metal powders are at least one member selected from a group consisting of aluminum powders and yttrium powders.

Preferably, in the method for preparing the protective coating on the surface of the key components and parts of the IC device based on the plasma spraying technology and the cold spraying technology, a particle size of the metal powders and the $Y_2O_3$ powders is in a range of 1-50 μm.

Preferably, in the step (2) of the method for preparing the protective coating on the surface of the key components and parts of the IC device based on the plasma spraying technology and the cold spraying technology, the mixed powders are directly sprayed on the inner surface of the plasma etching chamber through the plasma spraying technology, and simultaneously plasma spraying parameters are controlled, wherein main working gas used in the plasma spraying technology is argon, secondary working gas is hydrogen, powder feeding gas is nitrogen, and gas flow rates thereof are in a range of 10-80 mL/min, 5-220 mL/min and 5-80 mL/min, respectively; a spraying distance is in a range of 10-100 mm, so that the mixed powders are deposited on the inner surface of the plasma etching chamber, so as to obtain the evenly distributed (metal+$Y_2O_3$) transition coating.

Preferably, in the step (3) of the method for preparing the protective coating on the surface of the key components and parts of the IC device based on the plasma spraying technology and the cold spraying technology, the high-purity $Y_2O_3$ powders are deposited on the metal+$Y_2O_3$ transition layer obtained by the step (2) through the cold spraying high-speed deposition technology, and simultaneously cold spraying parameters are controlled, wherein compressed air is used as working gas, a temperature of the compressed air is in a range of 200 to 700° C., a pressure of the compressed air is in a range of 1.5 to 3.0 MPa, and a spraying distance is in a range of 10 to 60 mm, so that the high-purity $Y_2O_3$ powders are deposited on the metal+$Y_2O_3$ transition layer, so as to obtain the evenly distributed high-purity $Y_2O_3$ protective coating.

Preferably, in the method for preparing the protective coating on the surface of the key components and parts of the IC device based on the plasma spraying technology and the cold spraying technology, a porosity of the protective coating is below 2%, an interface bonding strength of the protective coating and the substrate is in a range of 20 to 100 MPa, and a thickness of the protective coating is in a range of 10 to 400 μm.

The design idea of the present invention is described as follows.

The metal+$Y_2O_3$ transition layer is prepared on the key components and parts of the IC device through plasma spraying technology for reducing the huge difference in expansion coefficient between the $Y_2O_3$ ceramic coating and the metal substrate, and enhancing the bonding force between the $Y_2O_3$ ceramic coating and the metal substrate. And then, the high-purity $Y_2O_3$ coating is deposited on the metal+$Y_2O_3$ transition layer through cold spraying high-speed deposition technology for fully maintaining the crystal form and excellent properties of $Y_2O_3$.

Through the plasma spraying technology and the cold spraying high-speed deposition technology, an evenly distributed protective coating is formed on the surface of the plasma etching chamber. The protective coating, having a double-layer composite structure, comprises a metal+$Y_2O_3$ transition layer deposited by plasma spraying as a lower layer of the double-layer composite structure, and a high-purity $Y_2O_3$ ceramic coating coated on the metal+$Y_2O_3$ transition layer as an upper layer of the double-layer composite structure, the metal+$Y_2O_3$ transition layer is configured to reduce the difference in expansion coefficient between the $Y_2O_3$ ceramic coating and the metal substrate, and enhance the bonding force between the $Y_2O_3$ ceramic coating and the metal substrate; the high-purity $Y_2O_3$ ceramic coating is formed by depositing $Y_2O_3$ ceramic powders on the metal+$Y_2O_3$ transition layer at high speed through cold spraying high-speed deposition. The present invention adopts the plasma spraying technology to prepare the metal+ceramics coating as the transition layer on the etching chamber of the IC device, and then adopts the cold spraying high-speed deposition technology to deposit the high-purity and high-density $Y_2O_3$ coating on the metal+ceramics coating, so as to obtain the (metal+$Y_2O_3$)/$Y_2O_3$ composite coating, which has better plasma erosion resistance and protective effect.

The present invention has some advantages and beneficial effects as follows.

(1) The present invention adopts the plasma spraying technology to prepare the metal+ceramics coating as the transition layer on the etching chamber of the IC device, and then adopts the cold spraying high-speed deposition technology to deposit the high-purity and high-density $Y_2O_3$ coating on the metal+ceramics coating, so as to obtain the (metal+$Y_2O_3$)/$Y_2O_3$ composite coating, which has better plasma erosion resistance and protective effect.

(2) In the present invention, through the plasma spraying technology and the cold spraying high-speed deposition technology, a (metal+$Y_2O_3$)/$Y_2O_3$ composite coating with a thickness in a range of 100-400 μm is prepared as a protective coating on the inner surface of the plasma etching chamber of the IC device. The method provided by the present invention has high deposition efficiency, the thickness of the (metal+$Y_2O_3$)/$Y_2O_3$ composite coating is able to be designed according to actual usage for preparing a thick protective coating of the plasma etching chamber of the IC device.

BRIEF DESCRIPTION OF THE DRAWINGS

The drawing is a schematic diagram of a (metal+$Y_2O_3$)/$Y_2O_3$ composite coating.

In the drawing, 1: substrate; 2: metal+$Y_2O_3$ transition layer; 3: high-purity $Y_2O_3$ coating.

DETAILED DESCRIPTION OF THE PREFERRED EMBODIMENT

In the specific embodiments provided by the present invention, metal powders and $Y_2O_3$ powders are mixed in accordance with a weight ratio in a range of (0.1-5):1. After the mixture is dried, micron mixed powders with a particle size in a range of 1-50 μm are obtained. The above-mentioned micron mixed powders and high-purity $Y_2O_3$ powders are preheated by heated compressed air and then deposited on an inner surface of a plasma etching chamber by plasma spraying technology or cold spraying technology in order of priority, so that a protective coating is obtained on the inner surface of the plasma etching chamber. The plasma spraying technology is specifically described as follows: when the main working gas is argon, the secondary working gas is hydrogen, and the powder feeding gas is nitrogen, gas flow rates thereof are in a range of 10-80 mL/min, 5-220 mL/min and 5-80 mL/min, respectively; a spraying distance is in a range of 10-100 mm. The cold spraying technology is specifically described as follows: the compressed air is used as working gas, a temperature of the compressed air is in a range of 200–700° C., a pressure of the compressed air is in a range of 1.5-3.0 MPa, and a spraying distance is in a range of 10-60 mm.

The present invention is further detailed described in combination with embodiments as follows.

First Embodiment

According to the first embodiment of the present invention, a method for preparing a protective coating on a 6061 aluminum alloy substrate for protecting an inner surface of a plasma etching chamber of an IC (integrated circuit) device comprises steps of:

(1) weighing 20 g of pure Al powders and 160 g of pure $Y_2O_3$ powders, mixing the pure Al powders with the $Y_2O_3$ powders, obtaining mixed micron (Al+$Y_2O_3$) powders after drying, weighing 300 g of high-purity $Y_2O_3$ powders with a purity of 99.99 wt. %, and drying the high-purity $Y_2O_3$ powders;

(2) preparing a (Al+$Y_2O_3$) coating with a thickness of 150 μm as a (Al+$Y_2O_3$) transition layer on the 6061 aluminum alloy substrate through plasma spraying technology by taking the mixed micron (Al+$Y_2O_3$) powders obtained by the step (1) as a raw material; and (3) depositing a high-purity $Y_2O_3$ coating with a thickness of 180 μm on the (Al+$Y_2O_3$) transition layer obtained by the step (2) through cold spraying high-speed deposition technology by taking the dried high-purity $Y_2O_3$ powders obtained by the step (1) as a raw material, so that a (Al+$Y_2O_3$)/$Y_2O_3$ composite coating as the protective coating is obtained.

In the step (2) of preparing the (Al+$Y_2O_3$) transition layer through plasma spraying technology, main working gas is argon, secondary working gas is hydrogen, powder feeding gas is nitrogen, and gas flow rates thereof are 30 mL/min, 220 mL/min and 30 mL/min, respectively; a spraying distance is 80 mm.

In the step (3) of depositing the high-purity $Y_2O_3$ coating through cold spraying high-speed deposition technology, compressed air is used as working gas, a temperature of the compressed air is 500° C., a pressure of the compressed air is 2.0 MPa, and a spraying distance is 20 mm.

As shown in the drawing, a metal+$Y_2O_3$ transition layer 2 is coated on a substrate 1 through plasma spraying technology, a high-purity $Y_2O_3$ coating 3 is coated on the metal+$Y_2O_3$ transition layer 2 through cold spraying high-speed deposition technology. The (Al+$Y_2O_3$)/$Y_2O_3$ composite coating provided by the first embodiment has a porosity of 2.0% and an interface bonding strength between a ceramic coating and the substrate is 45 MPa.

Second Embodiment

According to the second embodiment of the present invention, a method for preparing a protective coating on a 6061 aluminum alloy substrate for protecting an inner surface of a plasma etching chamber of an IC (integrated circuit) device comprises steps of:

(1) weighing 70 g of pure Al powders and 150 g of $Y_2O_3$ powders, mixing the pure Al powders with the $Y_2O_3$ powders, obtaining mixed micron (Al+$Y_2O_3$) powders after drying, weighing 200 g of high-purity $Y_2O_3$ powders with a purity of 99.99 wt. %, and drying the high-purity $Y_2O_3$ powders;

(2) preparing a (Al+$Y_2O_3$) coating with a thickness of 120 μm as a (Al+$Y_2O_3$) transition layer on the 6061 aluminum alloy substrate through plasma spraying technology by taking the mixed micron (Al+$Y_2O_3$) powders obtained by the step (1) as a raw material; and (3) depositing a high-purity $Y_2O_3$ coating with a thickness of 170 μm on the $(Al+Y_2O_3)$ transition layer obtained by the step (2) through cold spraying high-throughput deposition technology by taking the dried high-purity $Y_2O_3$ powders obtained by the step (1) as a raw material, so that a $(Al+Y_2O_3)/Y_2O_3$ composite coating as the protective coating is obtained.

In the step (2) of preparing the $(Al+Y_2O_3)$ transition layer through plasma spraying technology, main working gas is argon, secondary working gas is hydrogen, powder feeding gas is nitrogen, and gas flow rates thereof are 25 mL/min, 200 mL/min and 30 mL/min, respectively; a spraying distance is 90 mm.

In the step (3) of depositing the high-purity $Y_2O_3$ coating through cold spraying high-throughput deposition technology, compressed air is used as working gas, a temperature of the compressed air is 550° C., a pressure of the compressed air is 2.2 MPa, and a spraying distance is 20 mm.

As shown in the drawing, a metal+$Y_2O_3$ transition layer 2 is coated on a substrate 1 through plasma spraying technology, a high-purity $Y_2O_3$ coating 3 is coated on the metal+$Y_2O_3$ transition layer 2 through cold spraying high-throughput deposition technology. The $(Al+Y_2O_3)/Y_2O_3$ composite coating provided by the second embodiment has a porosity of 1.8% and an interface bonding strength between a ceramic coating and the substrate is 60 MPa.

Third Embodiment

According to the third embodiment of the present invention, a method for preparing a protective coating on a 6061 aluminum alloy substrate for protecting an inner surface of a plasma etching chamber of an IC (integrated circuit) device comprises steps of:

(1) weighing 40 g of pure Al powders and 120 g of $Y_2O_3$ powders, mixing the pure Al powders with the $Y_2O_3$ powders, obtaining mixed micron $(Al+Y_2O_3)$ powders after drying, weighing 400 g of high-purity $Y_2O_3$ powders with a purity of 99.99 wt. %, and drying the high-purity $Y_2O_3$ powders;

(2) preparing a $(Al+Y_2O_3)$ coating with a thickness of 160 μm as a $(Al+Y_2O_3)$ transition layer on the 6061 aluminum alloy substrate through plasma spraying technology by taking the mixed micron $(Al+Y_2O_3)$ powders obtained by the step (1) as a raw material; and (3) depositing a high-purity $Y_2O_3$ coating with a thickness of 180 μm on the $(Al+Y_2O_3)$ transition layer obtained by the step (2) through cold spraying high-speed deposition technology by taking the dried high-purity $Y_2O_3$ powders obtained by the step (1) as a raw material, so that a $(Al+Y_2O_3)/Y_2O_3$ composite coating as the protective coating is obtained.

In the step (2) of preparing the $(Al+Y_2O_3)$ transition layer through plasma spraying technology, main working gas is argon, secondary working gas is hydrogen, powder feeding gas is nitrogen, and gas flow rates thereof are 30 mL/min, 180 mL/min and 25 mL/min, respectively; a spraying distance is 100 mm.

In the step (3) of depositing the high-purity $Y_2O_3$ coating through cold spraying high-speed deposition technology, compressed air is used as working gas, a temperature of the compressed air is 600° C., a pressure of the compressed air is 2.3 MPa, and a spraying distance is 20 mm.

As shown in the drawing, a metal+$Y_2O_3$ transition layer 2 is coated on a substrate 1 through plasma spraying technology, a high-purity $Y_2O_3$ coating 3 is coated on the metal+$Y_2O_3$ transition layer 2 through cold spraying high-speed deposition technology. The $(Al+Y_2O_3)/Y_2O_3$ composite coating provided by the third embodiment has a porosity of 1.7% and an interface bonding strength between a ceramic coating and the substrate is 55 MPa.

Fourth Embodiment

According to the fourth embodiment of the present invention, a method for preparing a protective coating on a 6061 aluminum alloy substrate for protecting an inner surface of a plasma etching chamber of an IC (integrated circuit) device comprises steps of:

(1) weighing 40 g of pure Y powders and 120 g of $Y_2O_3$ powders, mixing the pure Y powders with the $Y_2O_3$ powders, obtaining mixed micron $(Y+Y_2O_3)$ powders after drying, weighing 400 g of high-purity $Y_2O_3$ powders with a purity of 99.99 wt. %, and drying the high-purity $Y_2O_3$ powders;

(2) preparing a $(Y+Y_2O_3)$ coating with a thickness of 120 μm as a $(Y+Y_2O_3)$ transition layer on the 6061 aluminum alloy substrate through plasma spraying technology by taking the mixed micron $(Y+Y_2O_3)$ powders obtained by the step (1) as a raw material; and (3) depositing a high-purity $Y_2O_3$ coating with a thickness of 180 μm on the $(Y+Y_2O_3)$ transition layer obtained by the step (2) through cold spraying high-speed deposition technology by taking the dried high-purity $Y_2O_3$ powders obtained by the step (1) as a raw material, so that a $(Y+Y_2O_3)/Y_2O_3$ composite coating as the protective coating is obtained.

In the step (2) of preparing the $(Y+Y_2O_3)$ transition layer through supersonic plasma spraying technology, main working gas is argon, secondary working gas is hydrogen, powder feeding gas is nitrogen, and gas flow rates thereof are 30 mL/min, 180 mL/min and 25 mL/min, respectively; a spraying distance is 100 mm.

In the step (3) of depositing the high-purity $Y_2O_3$ coating through cold spraying deposition technology, compressed air is used as working gas, a temperature of the compressed air is 650° C., a pressure of the compressed air is 2.3 MPa, and a spraying distance is 20 mm.

As shown in the drawing, a metal+$Y_2O_3$ transition layer 2 is coated on a substrate 1 through plasma spraying technology, a high-purity $Y_2O_3$ coating 3 is coated on the metal+$Y_2O_3$ transition layer 2 through cold spraying deposition technology. The $(Y+Y_2O_3)/Y_2O_3$ composite coating provided by the fourth embodiment has a porosity of 1.5% and an interface bonding strength between a ceramic coating and the substrate is 35 MPa.

The results of the above embodiments show that, in the method for preparing the protective coating on the inner surface of the plasma etching chamber of the IC device, the plasma spraying technology and the cold spraying high-speed deposition technology are used to prepare the (metal+$Y_2O_3$)/$Y_2O_3$ composite coating. The coating, which is well bonded to the substrate, has the porosity of less than 2%, the interface bonding strength in a range of 30-80 MPa, and the thickness in a range of 100-400 μm. The coating is able to reduce the corrosion of corrosive gas to the etching chamber and the pollution of the plasma to the chip, and improve the service life of the plasma etching chamber in the process of producing the chip.

The above are detailed embodiments and specific operation processes based on the technical solutions provided by the present invention, but the protective scope of the present invention is not limited to the above embodiments.

What is claimed is:

1. A method for preparing a protective coating on a surface of key components and parts of an IC (integrated circuit) device, the method comprising steps of:

(1) depositing a metal+$Y_2O_3$ transition layer on an inner surface of a plasma etching chamber of the IC device by directly spraying a mixture of dried metal powders and dried $Y_2O_3$ powders on the inner surface of the plasma etching chamber through plasma spraying, wherein main working gas used in the plasma spraying is argon with a gas flow rate in a range of 10-80 mL/min, secondary working gas is hydrogen with a gas flow rate in a range of 5-220 mL/min, powder feeding gas is nitrogen with a gas flow rate in a range of 5-80 mL/min, and a spraying distance is in a range of 10-100 mm; and (2) depositing a high-purity $Y_2O_3$ coating on the metal+$Y_2O_3$ transition layer by spraying high-purity $Y_2O_3$ powders on the metal+$Y_2O_3$ transition layer through supersonic cold gas spray, wherein a purity of the high-purity $Y_2O_3$ powders is above 99.9 wt. %, so that the protective coating, which comprises the metal+$Y_2O_3$ transition layer and the high-purity $Y_2O_3$ coating coated on the metal+$Y_2O_3$ transition layer, is formed.

2. The method according to claim 1, wherein in the step (2), compressed air is used as working gas, a temperature of the compressed air is in a range of 200 to 700° C., a pressure of the compressed air is in a range of 1.5 to 3.0 MPa, and a spraying distance is in a range of 10 to 60 mm.

3. The method according to claim 2, wherein the metal powders are at least one member selected from a group consisting of aluminum powders and yttrium powders.

4. The method according to claim 3, wherein a particle size of the metal powders and the $Y_2O_3$ powders is in a range of 1-50 μm.

5. The method according to claim 4, wherein a porosity of the protective coating is below 2%, an interface bonding strength of the protective coating and the inner surface of the plasma etching chamber is in a range of 20 to 100 MPa, and a thickness of the protective coating is in a range of 10 to 400 μm.

6. The method according to claim 3, wherein a porosity of the protective coating is below 2%, an interface bonding strength of the protective coating and the inner surface of the plasma etching chamber is in a range of 20 to 100 MPa, and a thickness of the protective coating is in a range of 10 to 400 μm.

7. The method according to claim 2, wherein a particle size of the metal powders and the $Y_2O_3$ powders is in a range of 1-50 μm.

8. The method according to claim 7, wherein a porosity of the protective coating is below 2%, an interface bonding strength of the protective coating and the inner surface of the plasma etching chamber is in a range of 20 to 100 MPa, and a thickness of the protective coating is in a range of 10 to 400 μm.

9. The method according to claim 2, wherein a porosity of the protective coating is below 2%, an interface bonding strength of the protective coating and the inner surface of the plasma etching chamber is in a range of 20 to 100 MPa, and a thickness of the protective coating is in a range of 10 to 400 μm.

10. The method according to claim 1, wherein the metal powders are at least one member selected from a group consisting of aluminum powders and yttrium powders.

11. The method according to claim 10, wherein a particle size of the metal powders and the $Y_2O_3$ powders is in a range of 1-50 μm.

12. The method according to claim 11, wherein a porosity of the protective coating is below 2%, an interface bonding strength of the protective coating and the inner surface of the plasma etching chamber is in a range of 20 to 100 MPa, and a thickness of the protective coating is in a range of 10 to 400 μm.

13. The method according to claim 10, wherein a porosity of the protective coating is below 2%, an interface bonding strength of the protective coating and the inner surface of the plasma etching chamber is in a range of 20 to 100 MPa, and a thickness of the protective coating is in a range of 10 to 400 μm.

14. The method according to claim 1, wherein a particle size of the metal powders and the $Y_2O_3$ powders is in a range of 1-50 μm.

15. The method according to claim 14, wherein a porosity of the protective coating is below 2%, an interface bonding strength of the protective coating and the inner surface of the plasma etching chamber is in a range of 20 to 100 MPa, and a thickness of the protective coating is in a range of 10 to 400 μm.

16. The method according to claim 1, wherein a porosity of the protective coating is below 2%, an interface bonding strength of the protective coating and the inner surface of the plasma etching chamber is in a range of 20 to 100 MPa, and a thickness of the protective coating is in a range of 10 to 400 μm.

* * * * *